US011051612B2

(12) United States Patent
Galin et al.

(10) Patent No.: US 11,051,612 B2
(45) Date of Patent: Jul. 6, 2021

(54) PORTABLE TABLE TOP

(71) Applicants: Jeffrey R. Galin, Boca Raton, FL (US); Matthew Kaplan, Palm Beach Gardens, FL (US)

(72) Inventors: Jeffrey R. Galin, Boca Raton, FL (US); Matthew Kaplan, Palm Beach Gardens, FL (US)

( * ) Notice: Subject to any disclaimer, the term of this patent is extended or adjusted under 35 U.S.C. 154(b) by 0 days.

(21) Appl. No.: 16/459,820

(22) Filed: Jul. 2, 2019

(65) Prior Publication Data

US 2020/0008572 A1 Jan. 9, 2020

Related U.S. Application Data

(60) Provisional application No. 62/694,470, filed on Jul. 6, 2018.

(51) Int. Cl.

| | |
|---|---|
| ***A47B 23/04*** | (2006.01) |
| ***A47B 23/00*** | (2006.01) |
| ***A47B 13/08*** | (2006.01) |

(52) U.S. Cl.

CPC ..... *A47B 23/043* (2013.01); *A47B 13/081* (2013.01); *A47B 23/002* (2013.01)

(58) Field of Classification Search

CPC ... A47B 23/001; A47B 23/002; A47B 23/041; A47B 2023/005

USPC ..... 108/43, 44, 45; 248/444, 463

See application file for complete search history.

(56) References Cited

U.S. PATENT DOCUMENTS 925,284 A * 6/1909 Buck ..... A47B 23/046 108/8
1,491,289 A * 4/1924 Clifford ..... A47B 23/06 248/451
1,859,320 A * 5/1932 Wetmore ..... A47B 23/041 108/115
2,538,318 A * 1/1951 Mitchell ..... G09F 1/14 248/448
2,833,608 A * 5/1958 Tobias ..... B60N 3/001 108/44
3,821,936 A * 7/1974 Morse ..... A47B 23/002 108/43
4,404,915 A * 9/1983 Simpson ..... A47B 3/08 108/129
4,619,386 A * 10/1986 Richardson ..... B60R 7/06 108/44
4,830,243 A * 5/1989 Mann ..... A61H 3/00 108/44
5,331,904 A * 7/1994 DiSimone ..... B25H 1/12 108/143
5,628,439 A * 5/1997 O'Hara ..... B60N 3/001 108/25
5,690,309 A * 11/1997 Blum ..... A47B 23/041 248/444

(Continued)

*Primary Examiner* — Jose V Chen

(74) *Attorney, Agent, or Firm* — McHale & Slavin, P.A.

(57) ABSTRACT

A portable table top formed from a base having multiple legs and brackets for accommodating various positions. Extension brackets are attached to side edges which engage a mounting tab slidably insertable into a cavity formed on each side edge of the base. A centrally positioned support having a first end pivotably mounted to a lower surface of the base provides a three point support. Legs are provided if the base is to be used on flat table as an angled work surface.

7 Claims, 15 Drawing Sheets

(56) References Cited

U.S. PATENT DOCUMENTS

| | | | | | |
|---|---|---|---|---|---|
| 5,797,578 | A * | 8/1998 | Graffeo | A47B 23/043 | 248/453 |
| 5,971,148 | A * | 10/1999 | Jackson | G06F 1/1628 | 108/43 |
| 6,003,446 | A * | 12/1999 | Leibowitz | A47B 23/002 | 108/43 |
| 6,173,656 | B1 * | 1/2001 | Blanchard | A47B 23/002 | 108/43 |
| 6,269,948 | B1 * | 8/2001 | Jackson | A45C 7/0095 | 108/43 |
| 6,353,530 | B1 * | 3/2002 | Zarek | G06F 1/1616 | 108/131 |
| 6,439,133 | B1 * | 8/2002 | Jaramillo | A47B 1/08 | 108/25 |
| 7,201,353 | B1 | 4/2007 | Freeman | | |
| 7,891,632 | B2 * | 2/2011 | Rucinski | A47B 23/044 | 248/447 |
| 8,651,446 | B2 * | 2/2014 | Lausell | A47B 23/00 | 248/444 |
| 2002/0145098 | A1 | 10/2002 | Thompson | | |
| 2007/0290114 | A1 | 12/2007 | Tsang et al. | | |
| 2009/0084291 | A1 * | 4/2009 | Long | B60N 3/005 | 108/44 |
| 2010/0006735 | A1 | 1/2010 | Reinen | | |
| 2010/0300334 | A1 | 12/2010 | Tcholakov | | |
| 2011/0017105 | A1 | 1/2011 | Valdivia | | |
| 2011/0219988 | A1 | 9/2011 | Stephens | | |
| 2011/0297050 | A1 | 12/2011 | Adams | | |
| 2012/0255389 | A1 | 10/2012 | Wang | | |
| 2013/0192498 | A1 | 8/2013 | Bullock et al. | | |
| 2015/0301566 | A1 | 10/2015 | Santiago | | |

* cited by examiner

PORTABLE TABLE TOP

PRIORITY CLAIM

In accordance with 37 C.F.R. 1.76, a claim of priority is included in an Application Data Sheet filed concurrently herewith. Accordingly, the present application claims priority to U.S. Provisional Patent Application No. 62/694,470 entitled "Portable Table Top", filed Jul. 6, 2018. The contents of each of the above referenced applications are incorporated herein by reference.

FIELD OF THE INVENTION

This invention is directed to desktops, and in particular, to a portable table top that is constructed and arranged for use as a chair mounted lap desk, an elevated table top for use as a writing platform, or a desktop securable to a vehicle.

BACKGROUND OF THE INVENTION

Portable table tops are well known to the consuming public. A portable table top is typically an adjustable platform that can be placed in various positions to operate as a lap desk or elevated platform on an existing tabletop. The platform provides an area for placement of reading books, computers, writing materials, food stuffs, or anything else that an individual may want placed before them on a desk type support. Unfortunately, the weight of a portable table top resting on an individual's lap or legs can be uncomfortable. The heat build-up from a platform resting on the individual's lap or legs can quickly make use of the platform most uncomfortable.

Portable table tops are also used in automobiles as many industries require employees to work in the field. For instance, contractors may utilize their vehicle to operate as a mobile office wherein a writing platform is beneficial if not a necessity. All known computer desks that attach to a vehicle steering wheel is either not positioned ergonomically or take up too much room because car seats often do not go back far enough to use them.

In many instances, an individual may wish to use the platform while resting in an arm chair and then use the platform in driver's seat of an automobile. In such instances, the platform needs to be adjustable to provide a level, stable platform with sufficient spacing to enable ergonomic positioning to avoid the aforementioned uncomfortable positions caused by a conventional lap desk with provisions for securing a computer thereto to prevent accidents when moving it.

What is lacking in the art is a platform that can be adjusted to span the distance between chair arm rests, attached to a vehicle's steering wheel in an ergonomic position despite the limited room, or adopted to operate as an elevated platform when set over a conventional table top, sofa or bed.

SUMMARY OF THE INVENTION

A portable table top formed from a base having extension brackets slidably attached to each side edge. The extension brackets each have a mounting tab slidably insertable into a cavity formed on each side edge. The extension brackets can slide outwardly from the base, expanding the width of the base for holding material; the extension brackets can also be used to bridge the distance between arm rests, allowing the base to be used as a portable table top. A centrally positioned support having a first end pivotably mounted to a lower surface and a second pivot joint between the first and the broad unidirectional foot supports the base on a seat cushion or operates as a hook for placement over an automobile steering wheel. The second joint enables the foot to support the desk on nearly any seating surface that does not have elevated support for legs such as a recliner. Rear legs are provided if the base is to be used as an elevated desk or food tray.

An objective of the instant invention is to provide a portable table top that works in conjunction with a chair, wherein extension brackets are used to bridge the space between chair arm rests.

Another objective of the invention is to provide a portable table top having a centrally disposed support for engaging the seat cushion of a chair.

Still another objective of the invention is to provide mounting brackets for cup holders and trays that secure the base of the platform to an extension bracket in a fixed position.

Another objective of the invention is to provide support legs that at the bottom corners of the platform to be used in an elevated position over a table top.

Another objective of the invention is to provide an ergonomic desk that can be hooked over an automobile steering wheel providing a portable writing surface.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

Figure 1:
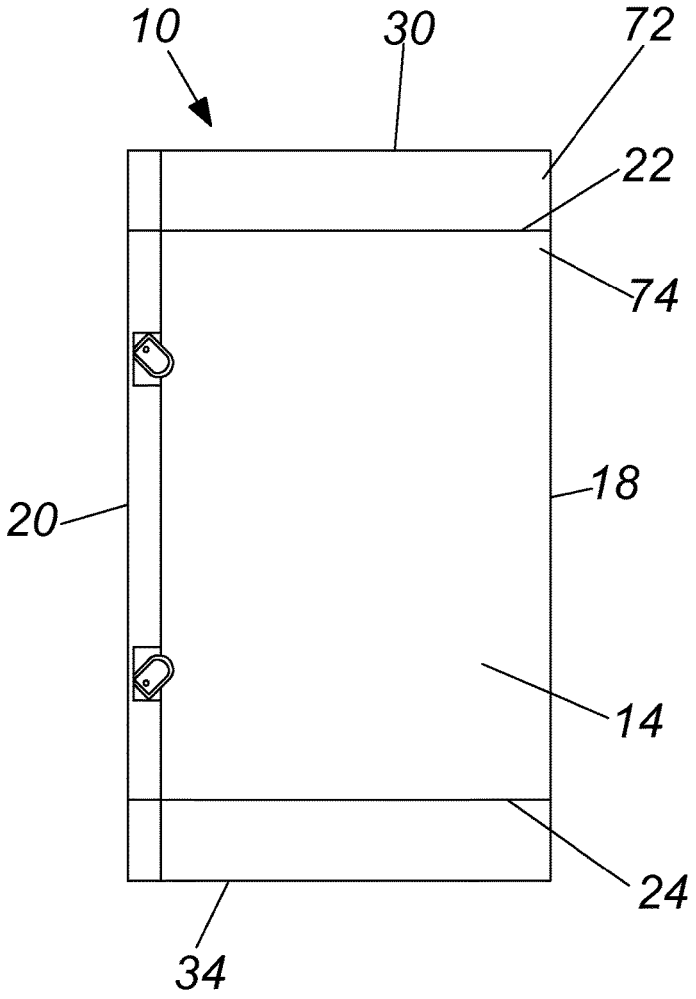
FIG. 1 is a top plane view of the portable table top in a storage position.
Figure 2:
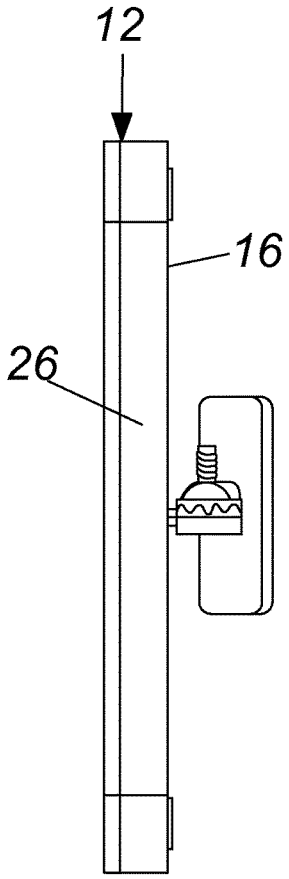
FIG. 2 is a bottom edge view thereof.
Figure 3:
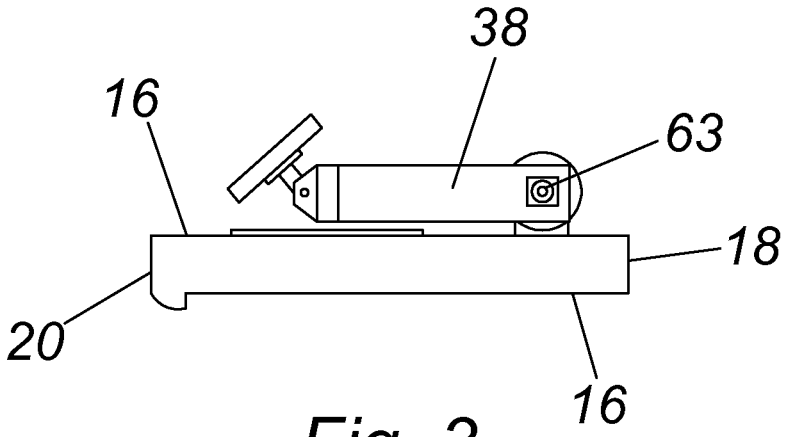
FIG. 3 is a right side edge view thereof.
Figure 4:
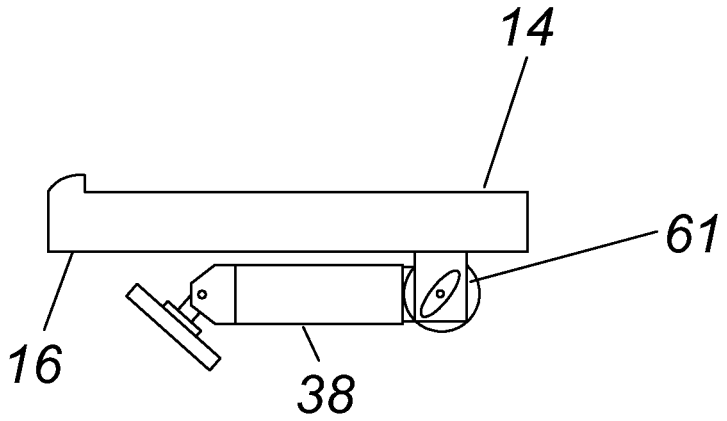
FIG. 4 is a left side edge view thereof.
Figure 6:
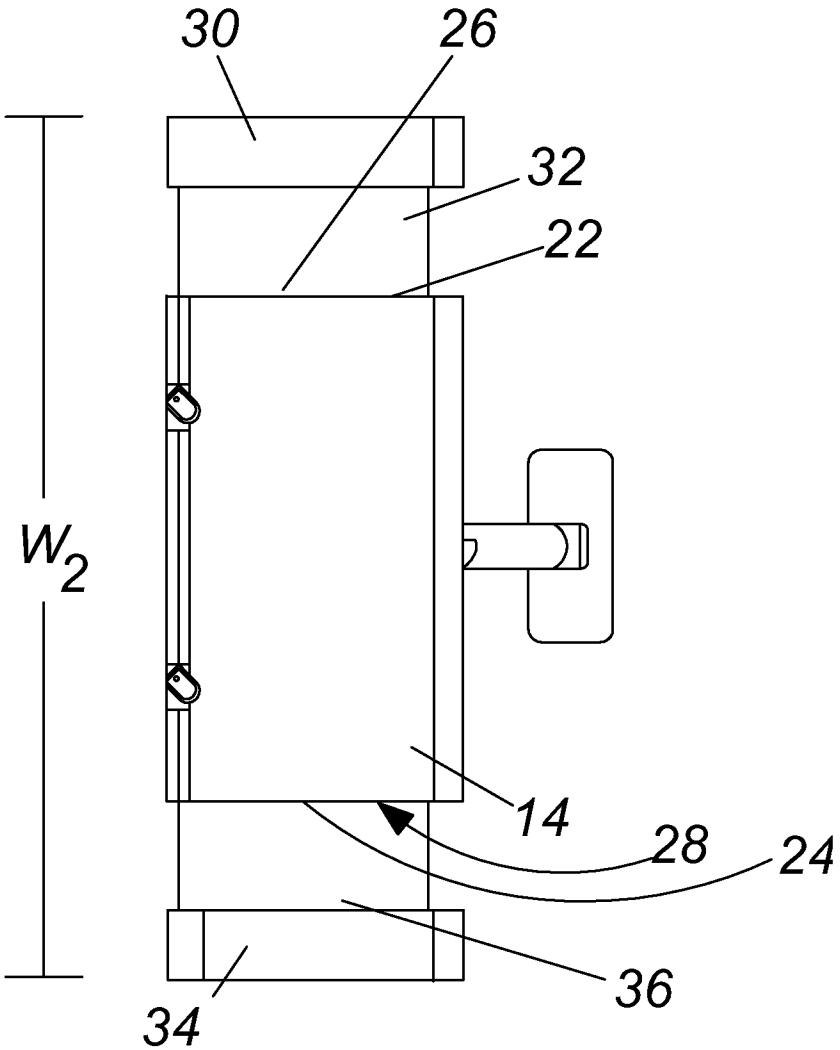
FIG. 6 is a bottom edge view thereof.
Figure 5:
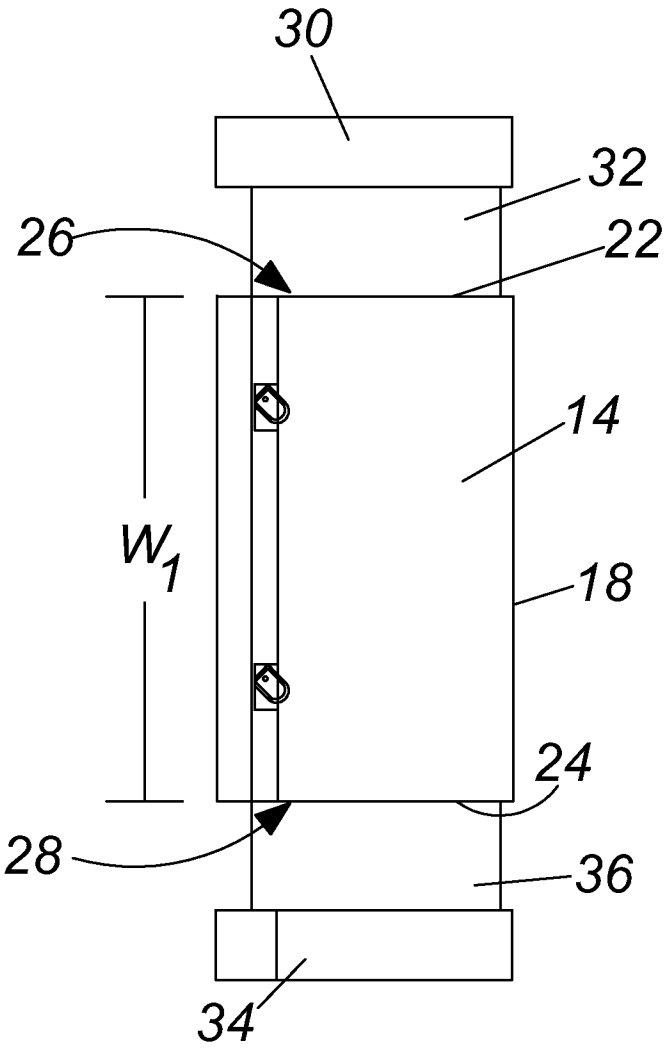
FIG. 5 is a top plane view in a deployed position.
Figure 7:
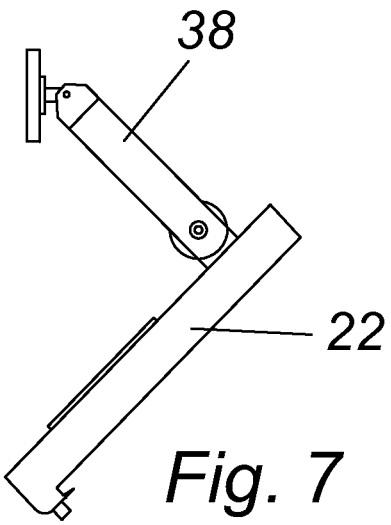
FIG. 7 is a right side edge view thereof.
Figure 8:
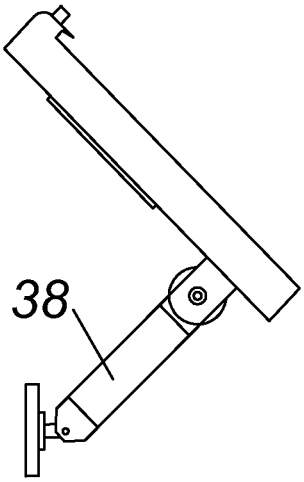
FIG. 8 is a left side edge view thereof.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring to FIGS. 1-8, set forth is a preferred embodiment of the portable table top 10 comprising a base 12 having an upper surface 14, a lower surface 16, a top edge 18, a bottom edge 20, a left edge 22, and a right edge 24. The left edge 22 includes a first cavity 26 formed between the upper surface 14 and the lower surface 16. The right edge 24 includes a second cavity 28 formed between the upper surface 14 and the lower surface 16.

A left extension bracket 30 has a mounting tab 32 which is slidably insertable in the first cavity 26; the left extension bracket 30 extending between the top edge 18 and the bottom edge 20. A right extension bracket 34 forms a mirror image of the left extension bracket 30. The right extension bracket 34 employs a mounting tab 36 which is slidably insertable in the second cavity 28. The left and right extension brackets 30, 34 slide outwardly from the base 12, to expand the width W1 between the left and right edges 22, 24 to an expanded width W2. The width of the portable table top 10 is expanded to provide a larger upper surface 14 area for holding writings, laptops, food stuff or anything else an individual may desire to support. The base 12 and the extension brackets 30, 34 may be constructed from wood, plastic, or other rigid material.

FIGS. 7-10 illustrate a centrally positioned support 38, pivotably mounted to the lower surface 16 of the base 12 using a mounting plate 35 having a threaded aperture 37. A center support 38 having a shank 39 threadably attached to the mounting plate 35. The center support 38 having a ball 41 formed on the end of the shank 39 for securement to clamp socket 45, the ball 41 including an aperture 43. The clamp socket 45 is formed from a body 47 having a threaded end 49 and an open end 51 having a first arm 53 with aperture 55 bifurcated from a second arm 57 with aperture 59. The ball 41 is positioned within the open end 51 with ball aperture 43 aligning with first arm 53 aperture 55 and second arm 57 aperture 59 for receipt of wing bolt 61 which passes through the apertures for engaging a hex nut fastener 63. The center support is threaded to a first extension base 73.

For addition flexibility, the preferred embodiment includes a second extension 173 as part of the centrally positioned support 38. In this embodiment the second extension 173 includes a ball 41 formed on the end of the shank 139 for securement to clamp socket 145, the ball 141 including an aperture 143. The clamp socket 145 is formed from a body 147 having a threaded end 149 and an open end 151 having a first arm 153 with aperture 155 bifurcated from a second arm 157 with aperture 159. The ball 141 is positioned within the open end 151 with ball aperture 143 aligning with first arm 153 aperture 155 and second arm 157 aperture 159 for receipt of wing bolt 161 which passes through the apertures for engaging a hex nut fastener 163.

The center support 38 allows the user to position the portable table top 10 in either a sitting position in a chair, or in a standing position on a desk table, sofa, or other surface, or against a steering wheel. A lower end employs a pivoting bracket 48, which is mounted to a planar foot base 50 for use in stabilizing the portable table top 10 in most any position. The planar foot base 50 has an extension mechanism 65 to allow the central support 40 to achieve the desired pitch of the table top for optimum ergonomic angle of the surface. The use of the first and second extension bases 73, 173 provides flexibility to accommodate most any position, including the engagement of a vehicle steering wheel wherein the center support 38 can hook over the steering to provide an in-vehicle writing table.

To make use of the portable table top 10 more comfortable when the user is sitting, the desk is expandable in width, allowing the left and right extension brackets 30, 34 to rest on the arm rests of a chair (not shown), and the centrally positioned support 40 can be pivoted to place the planar foot base 50 on the seat cushion between the legs of an individual, providing additional stability to the portable table top 10.

Alternatively, when the user finds it necessary to use the portable table top while in a standing position, the centrally positioned support 40 can be pivotably rotated to place the planar foot base 50 in a position to allow use of the portable table top 10 on a table, countertop or the like, wherein the platform is tilted at an angle.

Figure 9:
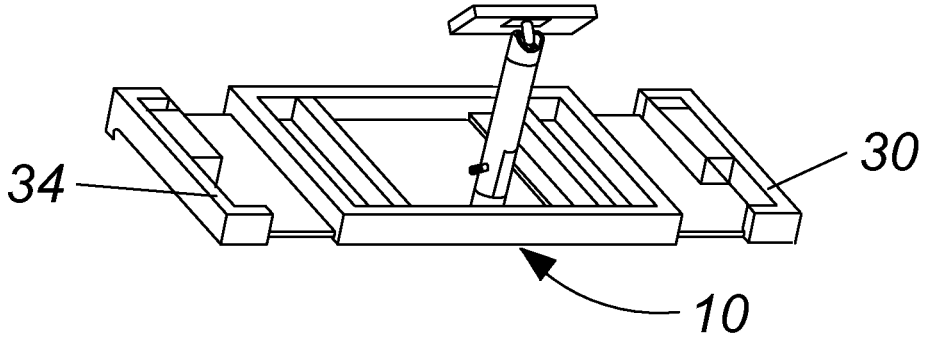
FIG. 9 is a lower perspective view thereof.
Figure 10:
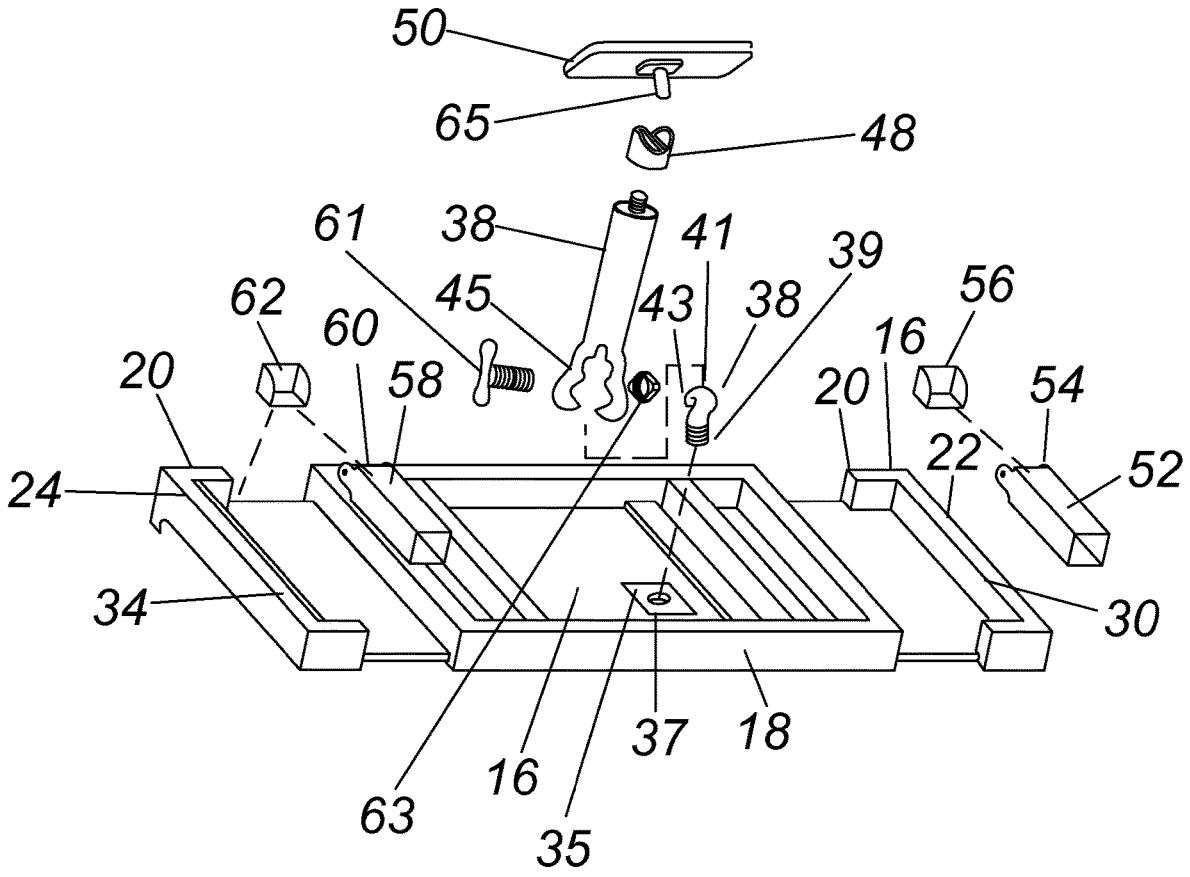
FIG. 10 is a lower exploded view thereof.

Alternatively, two additional legs can be used to support the platform. As illustrated in FIGS. 9 and 10, the portable table top 10 includes a first leg 52, having a first end 54 pivotably mounted to the lower surface 16, using a bracket 56, adjacent to the bottom edge 20 and the left edge 22. A second leg 58 has a first end 60 which is pivotably mounted to the lower surface 16, using a bracket 62, adjacent to the bottom edge 20 and the right edge 24. The first and second legs 52, 58 and the centrally positioned support 40 can be placed in a vertical position to allow the base 12 to be positioned to rest on a cabinet or desk top (not shown), allowing the base 12 to provide an elevated desk. Legs 52, 58 have extension mechanisms 57, 59 in their lower portions to adjust the height of the table when sitting on a flat surface to ensure the portable table does not rest on the user's thighs.

Figure 11:
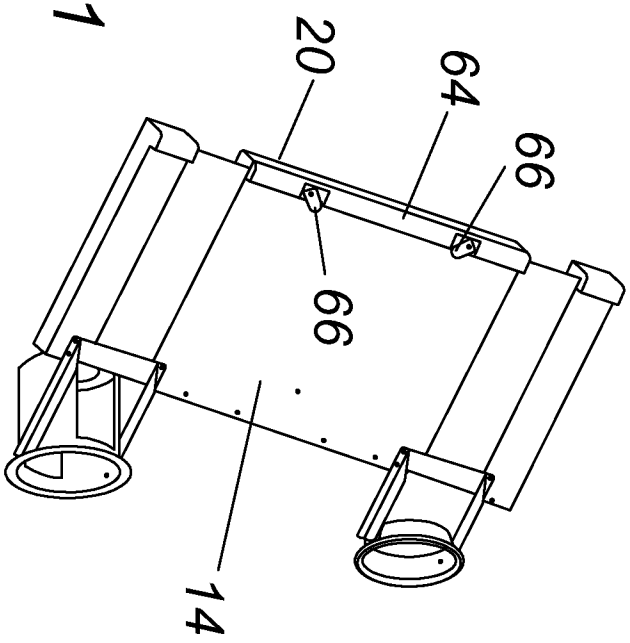
FIG. 11 is top perspective view with a cup and tray holder.
Figure 12:
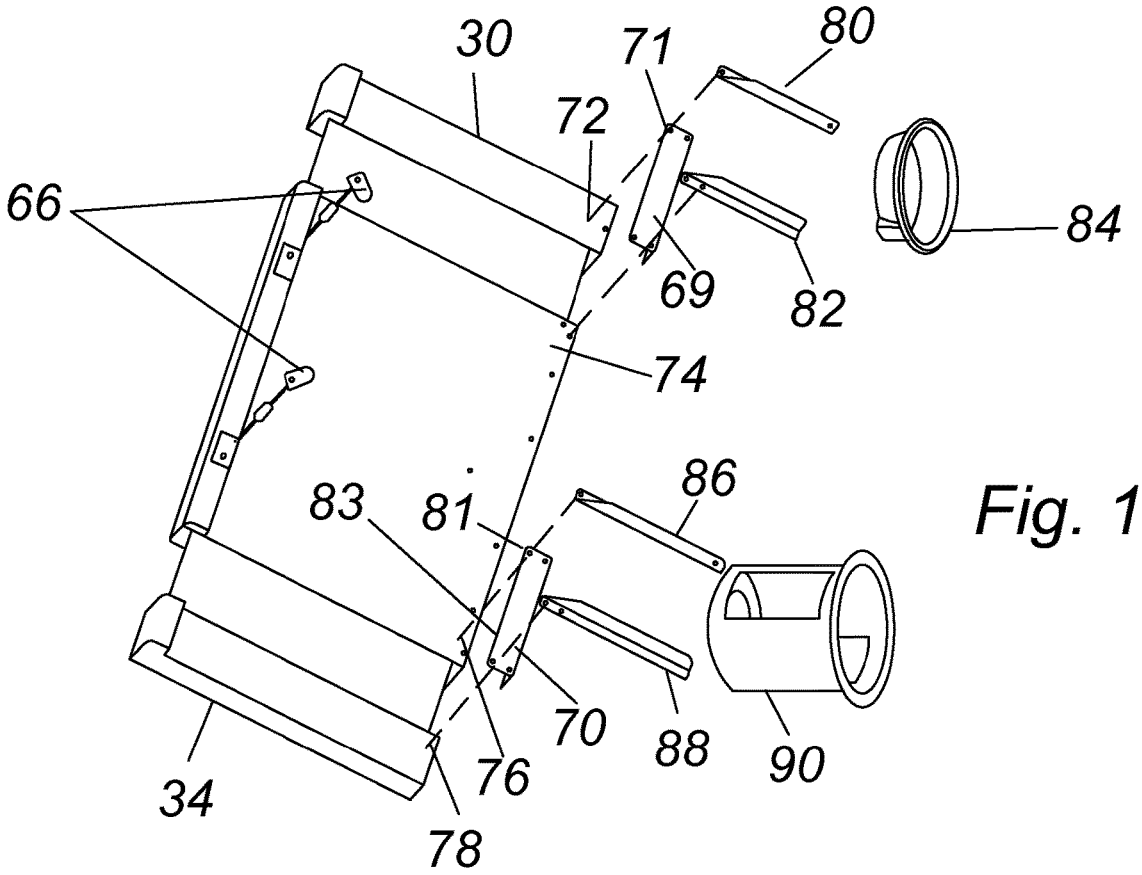
FIG. 12 is an exploded view thereof.
Figure 13:
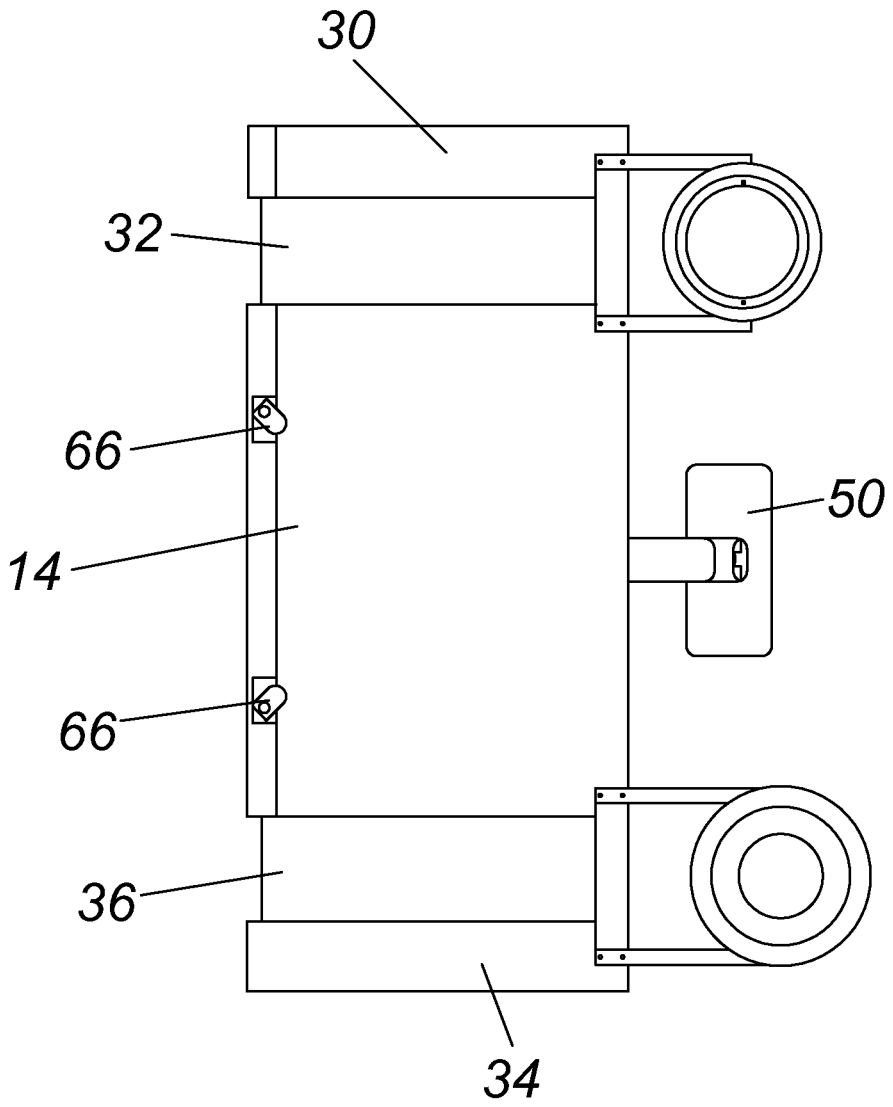
FIG. 13 is a top plane view of the portable table top with the cup holder and tray attached.
Figure 14:
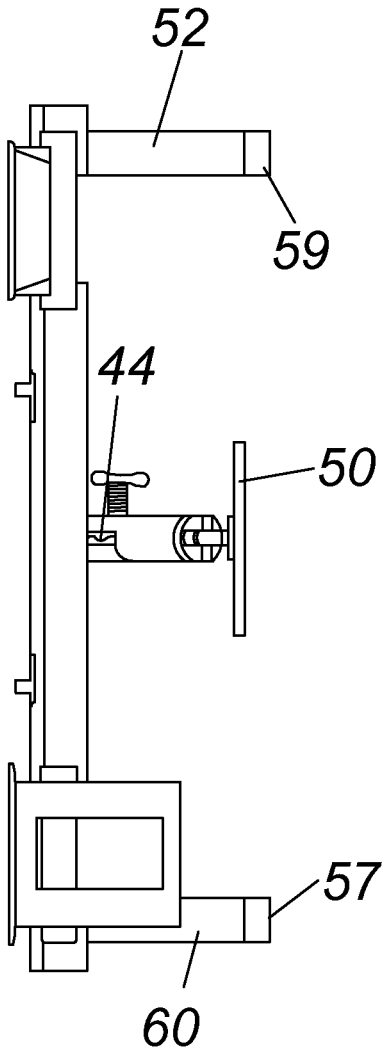
FIG. 14 is a top edge plane view thereof.
Figure 15:
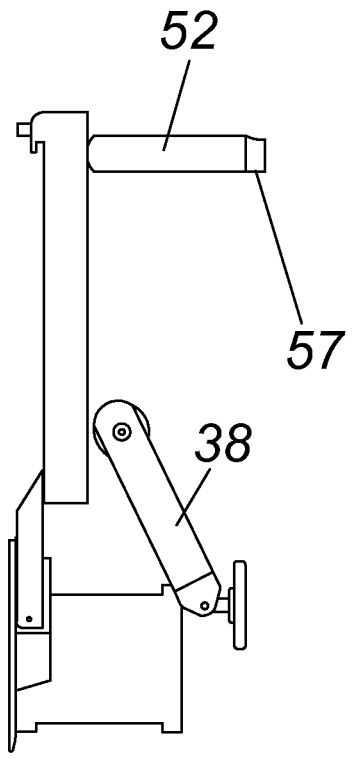
FIG. 15 is a side edge view thereof.
Figure 16:
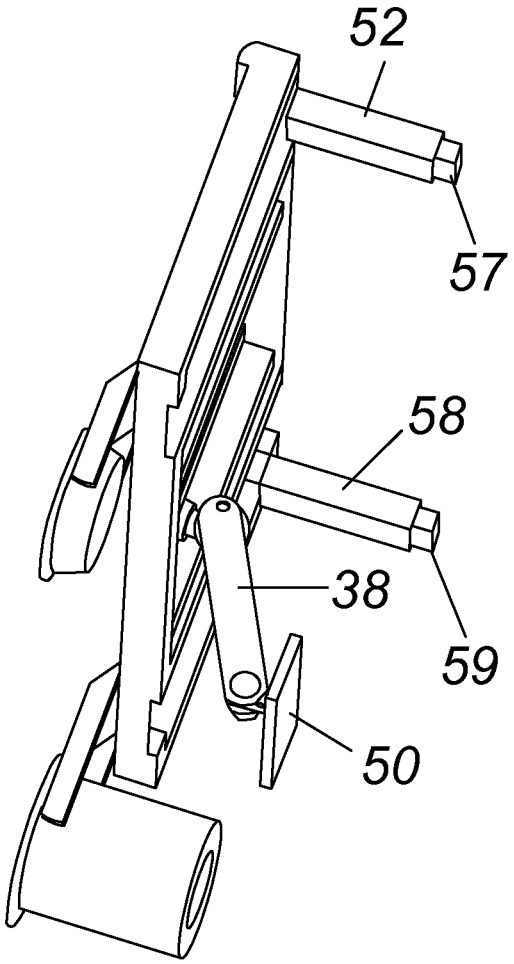
FIG. 16 is a lower perspective view thereof.
Figure 17:
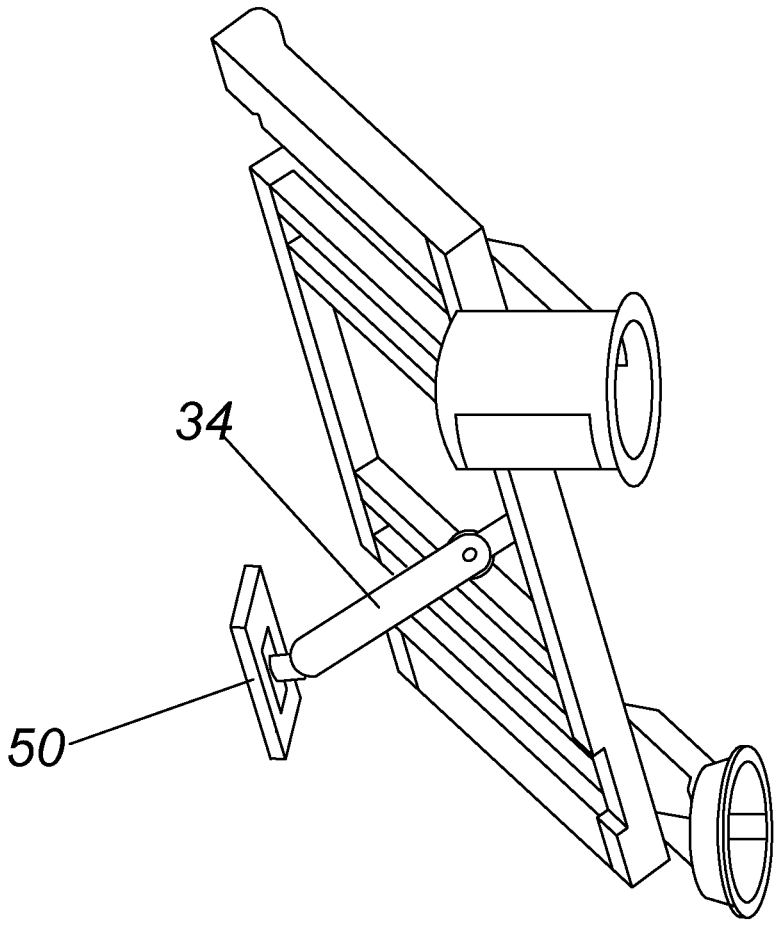
FIG. 17 is a lower perspective pictorial view thereof.
Figure 18:
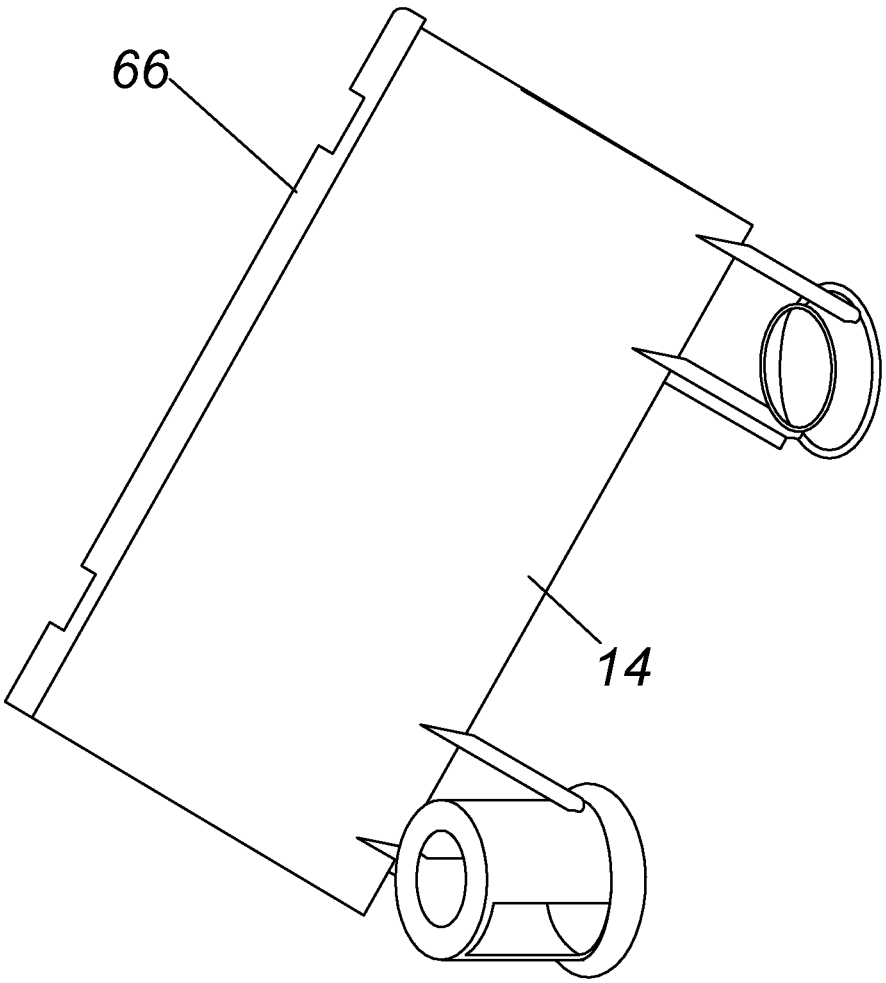
FIG. 18 is an upper perspective view thereof.
Figure 19:
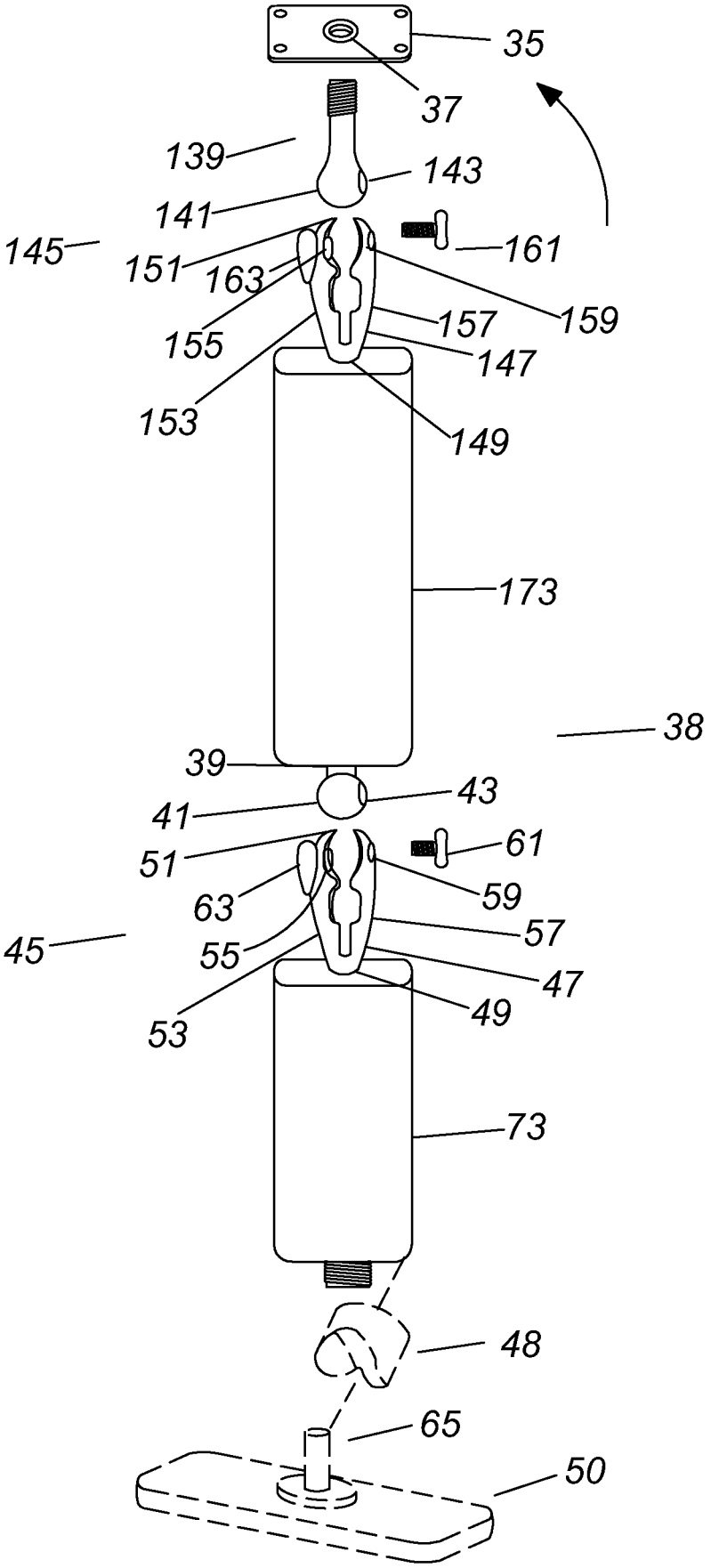
FIG. 19 is an exploded view of the clamp.

Referring now to FIG. 11, the portable table top 10 includes a lower lip 64 secured to the upper surface 14, adjacent to the bottom edge 20. The lower lip 64 is constructed and arranged to provide a base to hold material placed upon the upper surface 14. The lower lip 64 includes at least two spring loaded securement tabs 66, which are rotatable from a storage position parallel to the lower lip 64, to an engagement position perpendicular to the lower lip 64. The spring mechanism enables the clips to accommodate a computer whose thickness is higher than that of the lower lip. And an additional spacer bar is available to raise thin laptops or tablets to the level of the securement tabs.

Mounting bracket 68 contain insertion pins 69, 71 constructed and arranged to engage insertion holes 72, 74 respectively. The mounting bracket 68 includes support arms 80, 81 rigidly attached to the mounting bracket 68 and spaced apart for holding a tray 84. The bracket 68 locks the extension 30 in a spaced apart position with the upper surface 14 of the platform; the mounting bracket 68 thereby serving a dual function as a spacer element and for holding of a tray 84.

Mounting bracket 70 contains insertion pins 81, 83 constructed and arranged to engage insertion holes 76, 78, respectively. The mounting bracket 70 includes support arms 86, 88 rigidly attached to the mounting bracket 70 and spaced apart for holding a cup holder 90. The bracket 70 locks the extension 34 in a spaced apart position with the upper surface 14 of the platform; the mounting bracket 70 thereby serving a dual function as a spacer element and for holding of a cup holder 90.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more elements, but is not limited to possessing only those one or more elements.

What is claimed is:

1. A portable table top comprising:

a base having an upper writing surface spaced apart from a lower surface defining a thickness therebetween and bounded by a top edge, a bottom edge, a left edge and a right edge; said left edge including a first cavity formed inwardly between said upper and lower surface, and said right edge including a second cavity formed inwardly between said upper and lower surface;

a left extension bracket having a first mounting tab constructed and arranged for slidably insertion in said first cavity;

a right extension bracket having a second mounting tab constructed and arranged for slidably insertable in said second cavity;

a centrally disposed leg having a proximal end with a pivoting coupling secured to said lower surface of said base and a distal end having a planar foot base; and a mounting bracket having a first end releasably secured to said base and a second end releasably secured to one of said extension brackets, said mounting bracket maintaining said extension bracket in a spaced apart position relative to said base;

wherein said base is placed on the lap of an individual with said centrally positioned support placed between the individual's legs allowing said planar foot base to elevate a portion of said base above the individual's legs allowing said base to form an angled writing surface of the individual's lap; or wherein said base is placed on a table with said first leg and said second leg extended allowing said base to form an angled writing surface above the table; or wherein said base is placed on a chair with side arms whereby said left and right extension bracket are extended over the side chair side arms to form a flat writing surface.

2. The portable table top according to claim 1 including a lower lip secured to said upper surface adjacent said bottom edge, said lower lip constructed and arranged to provide a base to hold material placed upon said upper surface.

3. The portable table top according to claim 1 wherein said lower lip includes at least one spring loaded securement tab rotatable from a storage position parallel to said lower lip to an engagement position perpendicular to said lower lip.

4. The portable table top according to claim 1 including a first support arm securing a first side of a cup holder to a first end of said mounting bracket and a second support arm securing a second side of said cup holder to a second end of said mounting bracket.

5. The portable table top according to claim 1 wherein said mounting bracket employs insertion pins constructed and arranged to engage insertion holes along a top edge of said base.

6. The portable table top according to claim 1 including at least two spring loaded securement tabs rotably coupled to said writing surface of said base, said securement tabs rotatable from a storage position parallel to a lower lip of said base to an engagement position perpendicular to said lower lip.

7. The portable table top according to claim 1 wherein said base is constructed of wood or plastic.

* * * * *